US005350321A

United States Patent [19]

Takenouchi

[11] Patent Number: 5,350,321

[45] Date of Patent: Sep. 27, 1994

[54] FEMALE TERMINAL

[75] Inventor: Kenji Takenouchi, Shizuoka, Japan

[73] Assignee: Yazaki Corporation, Japan

[21] Appl. No.: 9,143

[22] Filed: Jan. 26, 1993

[30] Foreign Application Priority Data

Jan. 28, 1992 [JP] Japan ..... 4-012982

[51] Int. Cl.[5] ..... H01R 11/22

[52] U.S. Cl. ..... 439/839; 439/851

[58] Field of Search ..... 439/842, 843, 845, 849, 439/850-857, 861, 668, 669, 833, 839

[56] References Cited

U.S. PATENT DOCUMENTS

| | | | |
|---|---|---|---|
| 3,836,947 | 9/1974 | Yeager | 439/852 |
| 4,472,017 | 9/1984 | Sian | 439/850 |
| 4,838,816 | 6/1989 | Matsusaka et al. | 439/861 |
| 5,112,254 | 5/1992 | Endo | 439/856 |
| 5,158,485 | 10/1992 | Saito et al. | 439/851 |

FOREIGN PATENT DOCUMENTS 70487 6/1974 Japan .

*Primary Examiner*—David L. Pirlot

*Attorney, Agent, or Firm*—Wigman, Cohen, Leitner, & Myers

[57] ABSTRACT

A female terminal includes a cylindrical portion having an opening for insertion of a male terminal. The cylindrical portion contains an elastic contact portion for pressing the male terminal inserted through the opening against an inner wall of the cylindrical portion. The elastic contact portion has a first arm, a second arm, and a first vertex for connecting the first and the second arms. An end of the first arm is connected to the cylindrical portion in the vicinity of the opening thereof. The cylindrical portion is provided with a supporting portion for restricting a degree of deflection of the elastic contact portion. The supporting portion has a third arm to be brought into contact with the first arm of the elastic contact portion for restricting deflection of the elastic contact portion. Contact surfaces of the first and the third arms are adapted in shape to each other so as to assure tight contact therebetween.

4 Claims, 2 Drawing Sheets

FEMALE TERMINAL

BACKGROUND OF THE INVENTION

This invention relates to a female terminal comprising an electric contact portion of a cylindrical shape and an elastic contact piece formed in the electric contact portion.

For example, a conventional female terminal comprises an electric contact portion of a cylindrical shape having a forward opening for insertion of a male terminal, an elastic contact piece extending from the opening inwardly of the electric contact portion, and a protruding portion formed on an inner wall of the electric contact portion for restricting a degree of deflection of the elastic contact piece. Rearwardly of the electric contact portion, an insulation crimping portion and a conductor crimping portion for connecting a wire and a conductor, respectively, are formed.

Before the male terminal is inserted into the electric contact portion, the elastic contact piece is apart from the protruding portion. When the male terminal is inserted into the electric contact portion, the elastic contact piece is deflected to approach an outer periphery of the protruding portion. In this state, a little gap is left between the elastic contact piece and the outer periphery of the protruding portion. The elastic contact piece exerts its elastic force to press the male terminal against the inner wall of the electric contact portion. If the elastic contact piece is excessively deflected, the elastic contact piece is brought into contact with the outer periphery of the protruding portion. Thus, excessive displacement is prevented.

Instead of the male terminal, a probe of a tester for a continuity test of the female terminal or an extractor jig for extracting the female terminal from a terminal receptacle of a connector may be inserted into the electric contact portion of the female terminal. If the probe of the tester or the extractor Jig is brought into contact with the elastic contact piece in the vicinity of a bending portion thereof, the elastic contact piece is deformed due to presence of a gap between the elastic contact piece and the protruding portion. In this event, the elastic contact piece is plastically deformed to lose its elasticity. This phenomenon is called fatigue.

When the elastic contact piece loses its elasticity, it is impossible to press the male terminal against the electric contact portion and to hold the male terminal. In this event, a gap is formed between the electric contact portion and the male terminal. This results in a continuity failure.

SUMMARY OF THE INVENTION

In view of the above, it is an object of this invention to provide a female terminal capable of avoiding plastic deformation of an elastic contact piece so that the elastic contact piece does not lose its elasticity.

In order to achieve the above-mentioned object, this invention provides a female terminal for electrical connection with a male terminal, comprising:

a cylindrical portion having an opening for insertion of the male terminal;

an elastic contact portion contained in the cylindrical portion for pressing the male terminal inserted through the opening against an inner wall of the cylindrical portion, the elastic contact portion having a first arm, a second arm, and a first vertex connecting the first and the second arms, an end of the first arm being connected to the cylindrical portion in the vicinity of the opening thereof, an end of the second arm being a free end; and a supporting portion for restricting a degree of deflection of the elastic contact portion, the supporting portion having a third arm to be brought into contact with the first arm of the elastic contact portion to restrict deflection of the elastic contact portion;

wherein contact surfaces of the first and the third arms are adapted in shape to each other so as to assure tight contact therebetween.

According to this invention, when a probe of a tester or an extractor Jig is inserted into the cylindrical portion and presses the first arm of the elastic contact portion against the third arm of the supporting portion, the first arm is brought into tight contact with the third arm. Thus, pressing force exerted from the probe or the extractor jig is received both by the elastic contact portion and the supporting portion. Accordingly, the elastic contact portion is prevented from plastic deformation and resultant fatigue. As a result, it is possible to tightly hold the male terminal within the cylindrical portion without causing a continuity failure to occur.

DESCRIPTION OF THE PREFERRED EMBODIMENT

Now, an embodiment of this invention will be described with reference to the accompanying drawings hereinafter.

Figure 1:
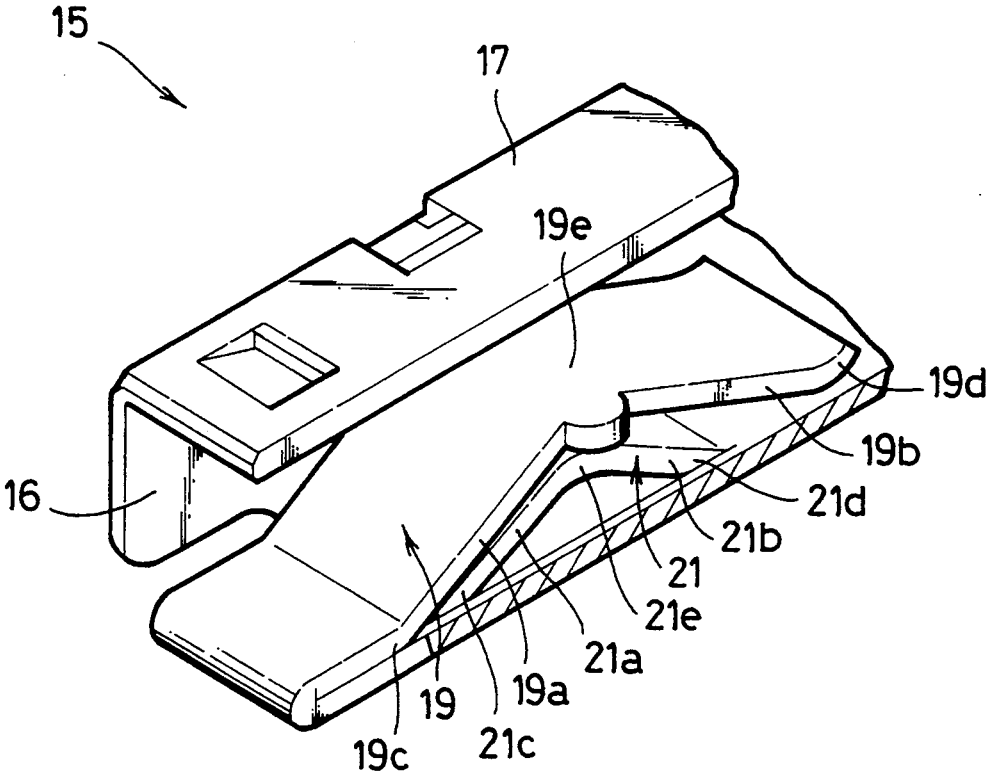
FIG. 1 is a perspective view of a female terminal according to an embodiment of this invention.
Figure 2:
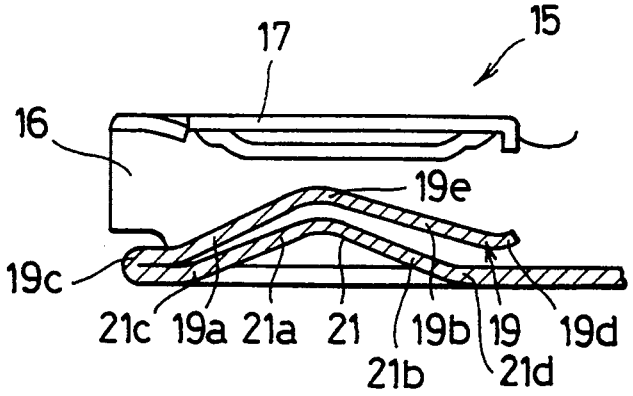
FIG. 2 is a partial sectional view of the female terminal in FIG. 1 before a male terminal is inserted into an electric contact portion.
Figure 3:
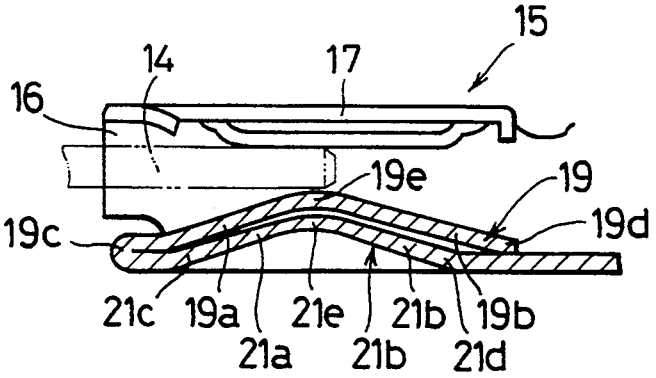
FIG. 3 is a sectional view similar to FIG. 2 where the male terminal is inserted into the electric contact portion.
Figure 4:
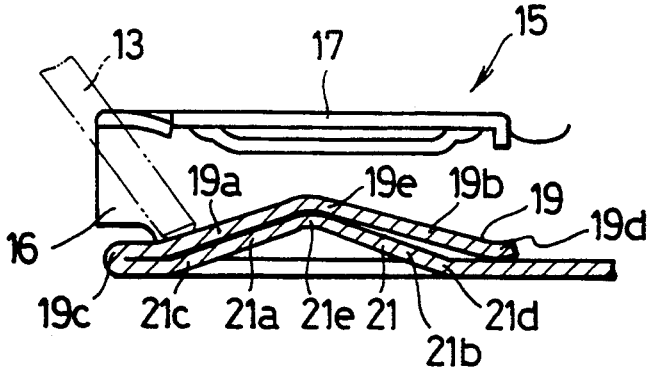
FIG. 4 is a sectional view similar to FIG. 2 where a probe of a tester is inserted into the electric contact portion.

FIGS. 1 through 4 show a female terminal 15. In the figure, the female terminal 15 comprises an electric contact portion 17 of a cylindrical shape having a forward opening 16 for insertion of a male terminal 14, an elastic contact piece 19 extending from the opening 16 inwardly of the electric contact portion 17, and a protruding portion 21 formed on an inner wall of the electric contact portion 17 for restricting a degree of deflection of the elastic contact piece 19. Rearwardly of the electric contact portion 17, an insulation crimping portion and a conductor crimping portion for connecting a wire and a conductor, respectively, are formed although not shown in the figure. The female terminal 15 is formed in an integral fashion by bending a single metal plate. The elastic contact piece 19 of the female terminal 15 extends from the opening 16 for insertion of the male terminal 14 and is bent towards the interior of the electric contact portion 17 into an arched shape comprising a first arm 19*a*, a second arm 19*b*, and a vertex 19*e*. The elastic contact piece 19 has a proximal end 19*c* and a distal end 19*d*. The proximal end 19*c* is a fixed end located at the opening 16. The distal end 19*d* is a free end located inwardly of the electric contact portion 17. The elastic contact piece 19 can be elastically deflected as illustrated in FIGS. 2 to 4.

On the other hand, the protruding portion 21 formed in the electric contact portion 17 has an arched shape comprising a vertex 21*e* located inwardly of the electric contact portion 17, and an ascending arm (third arm) 21*a* and a descending arm (fourth arm) 21*b* corresponding to the first and the second arms 19*a* and 19*b*, respectively. The protruding portion 21 is formed by making a part of a side wall of the electric contact portion 17 project inwardly. The vertex 21*e* of the protruding portion 21 corresponds to the vertex 19*e* of the elastic contact piece 19. The protruding portion 21 has opposite ends 21*c* and 21*d* integrally connected to the inner wall of the electric contact portion 17. The first arm 19*a* of the elastic contact piece 19 and the ascending arm 21*a* of the protruding portion 21 have contact surfaces adapted in shape to each other so as to assure tight contact between the first arm 19*a* and the ascending arm 21*a* when the elastic contact piece 19 is elastically deflected as illustrated in FIG. 4.

In this embodiment, the first arm 19*a* and the ascending arm 21*a* are formed into a plate-like shape. Accordingly, when the elastic contact piece 19 is deflected, the first arm 19*a* is brought into tight contact with the ascending arm 21*a* and is supported by the ascending arm 21*a*.

It is assumed that the female terminal having the above-mentioned structure is in a state, as illustrated in FIG. 2 before the male terminal 14 is inserted into the electric contact portion 17. In this event, the first arm 19*a* and the second arm 19*b* of the elastic contact piece 19 are apart from the ascending arm 21*a* and the descending arm 21*b* of the protruding portion 21, respectively, as illustrated in FIG. 2.

When the male terminal 14 is normally inserted into the electric contact portion 17 of the female terminal 15, the elastic contact piece 19 is deflected to approach the protruding portion 21. In this state, a little gap is left between the elastic contact piece 19 and the surface of the protruding portion 21 at vertex 21*a*. The elastic contact piece 19 presses the male terminal 14 against the inner wall of the electric contact portion 17 to hold the male terminal 14.

If the male terminal 14 is inserted into the electric contact portion 17 of the female terminal 15 in a slanted state, or when a probe 13 of a tester is inserted to perform a continuity test, the elastic contact piece 19 is deflected so that the elastic contact piece 19 is brought into tight contact with the protruding portion 21 and overlapped with the protruding portion 21 without leaving any gap between the ascending arm 21*a* and the first arm 19*a*, as illustrated in FIG. 4. In other words, the first arm 19*a* is supported by the ascending arm 21*a* with tight contact kept therebetween. Accordingly, the first arm 19*a* is prevented from plastic deformation due to the probe 13 and the like. In this state, the pressing force from the male terminal 14 or the probe 13 is received both by the elastic contact piece 19 and the protruding portion 21. Accordingly, the elastic contact piece 19 can avoid fatigue. As a result, no gap is left between the male terminal 4 and the electric contact portion 17. Consequently, a continuity failure is avoided.

When the male terminal 14 is extracted from the electric contact portion 17, the elastic contact piece 19 is restored into its original shape.

In the foregoing embodiment, the elastic contact piece of a bending type is integral with the electric contact portion. However, the elastic contact piece may be an independent member.

The second arm 19*b* of the elastic contact piece 19 may be or may not be brought into contact with the descending arm 21*b* of the protruding portion 21 upon insertion of the male terminal 14 or the like. The operation and the effect of this invention are not thereby affected at all.

In the foregoing embodiment, the first arm 19*a* of the elastic contact piece 19 is brought into tight contact and overlapped with the ascending arm 21*a* of the protruding portion 21 which serves to prevent the fatigue. However, a projecting portion may be formed at least one of opposite surfaces of the ascending arm 21*a* and the first arm 19*a* so as to reduce the gap between the protruding portion and the elastic contact piece 19.

What is claimed is:

1. A female terminal for electrical connection with a male terminal, comprising:

a cylindrical portion having an opening for insertion of said male terminal;

an elastic contact portion contained in said cylindrical portion for pressing said male terminal inserted through said opening against an inner wall of said cylindrical portion, said elastic contact portion having a first arm, a second arm, and a first vertex connecting said first and said second arms, an end of said first arm being connected to said cylindrical portion in the vicinity of said opening thereof, an end of said second arm being a free end; and a supporting portion for restricting a degree of deflection of said elastic contact portion, said supporting portion having a third arm to be brought into contact with said first arm of said elastic contact portion to restrict deflection of said elastic contact portion;

wherein contact surfaces of said first and said third arms are conformable to each other so as to assure close contact therebetween along the length thereof.

2. A female terminal as claimed in claim 1, wherein said elastic contact portion has an arched shape, said first and said second arm having a plate-like shape, an end of said first arm being integrally connected to said cylindrical portion in the vicinity of said opening thereof.

3. A female terminal as claimed in claim 1, wherein said supporting portion has an arched shape, said third arm being connected to a fourth arm through a second vertex.

4. A female terminal as claimed in claim 3, wherein said third and said fourth arms are formed into a plate-like shape, an end of each of said third and said fourth arms is integrally connected to said cylindrical portion.

* * * * *